US005599113A

United States Patent [19]

Suzuki et al.

[11] Patent Number: 5,599,113

[45] Date of Patent: Feb. 4, 1997

[54] THERMAL PRINTER

[75] Inventors: Minoru Suzuki; Kiyoshi Negishi; Katsumi Kawamura; Mikio Horie; Hiroshi Orita; Katsuyoshi Suzuki, all of Tokyo, Japan

[73] Assignee: Asahi Kogaku Kogyo Kabushiki Kaisha, Tokyo, Japan

[21] Appl. No.: 433,566

[22] Filed: May 3, 1995

[30] Foreign Application Priority Data

May 18, 1994 [JP] Japan ..... 6-128329

[51] Int. Cl.[6] ..... B41J 2/32

[52] U.S. Cl. ..... 400/120.16; 400/88; 400/692; 347/196

[58] Field of Search ..... 400/120.16, 120.17, 400/88, 691, 692, 693; 347/197, 198

[56] References Cited

U.S. PATENT DOCUMENTS

| | | | |
|---|---|---|---|
| 4,718,785 | 1/1988 | Spath | 400/120.16 |
| 4,909,645 | 3/1990 | Sudo et al. | 400/120.16 |
| 5,111,248 | 5/1992 | Kita et al. | 355/282 |
| 5,155,539 | 10/1992 | Yamaguchi et al. | 355/315 |
| 5,176,458 | 1/1993 | Wirth | 400/120.16 |
| 5,181,787 | 1/1993 | Hosomi | 400/120.16 |
| 5,193,919 | 3/1993 | Godo et al. | 400/120.16 |
| 5,198,836 | 3/1993 | Saito et al. | 346/76 PH |
| 5,253,013 | 10/1993 | Takano et al. | 355/200 |
| 5,276,536 | 1/1994 | Hokamura | 358/498 |

FOREIGN PATENT DOCUMENTS

| | | | |
|---|---|---|---|
| 61-213184 | 9/1986 | Japan | 400/120.16 |
| 2-1332 | 1/1990 | Japan | 400/120.16 |
| 2144082 | 2/1985 | United Kingdom . | |
| 2194920 | 3/1988 | United Kingdom . | |
| 2250478 | 6/1992 | United Kingdom . | |
| 2285716 | 7/1995 | United Kingdom . | |

OTHER PUBLICATIONS

European Search Report dated Aug. 31, 1995.

*Primary Examiner*—Christopher A. Bennett
*Attorney, Agent, or Firm*—Greenblum & Bernstein P.L.C.

[57] ABSTRACT

A compact thermal line printer includes a guiding portion that releases a thermal line printing head from contact with a platen roller responsive to opening of a cover member. The edges of the cover member are recessed to form paper insert and discharge slots when the cover member is closed. The guiding portion is arranged to hold the cover member open when the cover member opens past a predetermined point.

19 Claims, 7 Drawing Sheets

THERMAL PRINTER

BACKGROUND OF THE INVENTION

The present invention relates to thermal printer technology, and more specifically to thermal printers using a thermal line printing head (hereinafter referred to as a "printhead") to print images on thermosensitive paper.

Compact thermal printers using thermal line printheads are well known and widely used. Occasionally, a compact thermal printer is arranged to have a thermal line printhead pressed against a rotatable platen roller. To insert thermosensitive paper, or in the case of a paper jam, the thermal line printhead can be released from the platen roller by manually operating a release lever, which directly or indirectly moves either the platen roller or the printhead away from the other.

However, with the conventional compact thermal printer, the rotating axes of the release levers and associated mounting parts are, in most cases, located near the paper discharge slots. The paper discharge slot is often located in a lower portion of the printer's external casing, far from the rotating axis of the released part. This leads to the necessity for a strong release lever, or expanding the paper discharge slot. The conventional arrangement thereby renders paper insertion or jammed sheet removal operation inconvenient, and often results in an unwieldy structure. The salient problem is that conventional arrangements of insertion and discharge slots, release levers, printer housings, and printer covers are unsatisfactory for an extremely compact printer. It is therefore desirable to combine some of or all of the functions of the above-mentioned structural elements together.

Further, if the thermal line printhead sticks to the platen roller, the conventional paper release action may not always allow the thermal line printhead to separate from the platen roller the printer may therefore have unsatisfactory reliability. It is therefore desirable to be able to release the thermal line printhead from the platen roller.

SUMMARY OF THE INVENTION

Accordingly, the primary object of the present invention is to provide an improved compact thermal printer having an integrated and strong mechanical structure, a sufficiently large paper discharge slot, with simplified operations for paper insertion and jammed paper removal.

Another object of the present invention is to provide a thermal printer in which the thermal printhead separates from the platen roller by a release operation.

The objects are met by the invention by providing a thermal printer including a platen roller rotatably supported in the printer. A thermal line printhead swingably supported in the printer is contactable to the platen roller and swingable towards and away from the platen roller. A biasing mechanism biases the thermal line printhead to swing towards the platen roller. A covering member is rotatably supported in the printer, swingable about an axis to allow access to the interior of the printer. A guiding mechanism guides the thermal line printhead away from contact with the platen roller, in response to the swinging of the covering member to allow access to the interior of the printer, and against the bias of the biasing means. In this manner, when the covering member swings open, the thermal line printhead swings away from the platen roller, creating a gap in which the paper may be freely moved. There is no need for a release lever, as that function is served by the cover itself. Preferably, the guiding means includes a cam associated with the covering member and a cam follower associated with the thermal line printhead. Further preferably, the cam is formed about the axis of the covering member and the cam follower is displaced from a swinging axis of the swingable thermal line printhead. The printer preferably further includes at least one swingable support frame, rigidly holding the thermal line printhead while being swingable relative to the platen roller. The thermal line printhead is thereby swingable by means of the support frame and a cam follower provided to the swingable support frame. The cams, cam followers, and swinging support frames allow the implementation of the inventive concept in a very limited space.

According to another aspect of the present invention, the covering member is swingable between an open position that allows access through a printer housing to the interior of the printer, and a closed position that closes the access. The covering member has a first recess and a second recess. When the covering member is in the closed position, the first recess forms a paper insertion slot at an edge of the housing while the second recess forms a paper discharge slot at a remaining edge of the housing. Preferably, the housing includes a top surface and a side surface, and each of the top and side surfaces have an edge facing the closed covering member. In this case, the first recess of the covering member faces the top surface edge to form the paper insertion slot, and the second recess of the covering member faces the side surface edge to form the paper discharge slot. The use of the cover member (already serving to replace a release lever) to form the insert and discharge slot results in a compact printer, larger possible slots in the same space, and a reduction in the number of necessary parts. The housing preferably also includes a lower housing supporting a pair of fixed mounting plates. Each of the platen roller, thermal line printhead, and the cover are rotatably supported by the fixed mounting plates. In this case, an upper housing is fitted on top of the lower housing. The upper housing includes the top surface and the top surface edge, while the lower housing includes the side surface and the side surface edge. In this manner, the main stresses and interacting forces are resisted by the fixed mounting plates rather than the housing itself. The formation of the lower housing with the side surface edge results in a stronger housing and discharge slot, as the side surface edge may be made without breaks or steps. Ideally, the lower housing and upper housing are made of plastic materials, and the pair of mounting plates are made of metal.

According to yet another aspect of the present invention, the guiding mechanism further includes a mechanism for holding the covering member in position when the covering member swings more than a predetermined amount, and for returning the covering member to a predetermined position when the covering member swings less than the predetermined amount. In this manner, the cover stays open when opened to a paper access position, but is easily closed.

DESCRIPTION OF THE EMBODIMENTS

The embodiments of the thermal printer according to the present invention is detailed hereinafter, with reference to the accompanying drawings.

Figure 1:
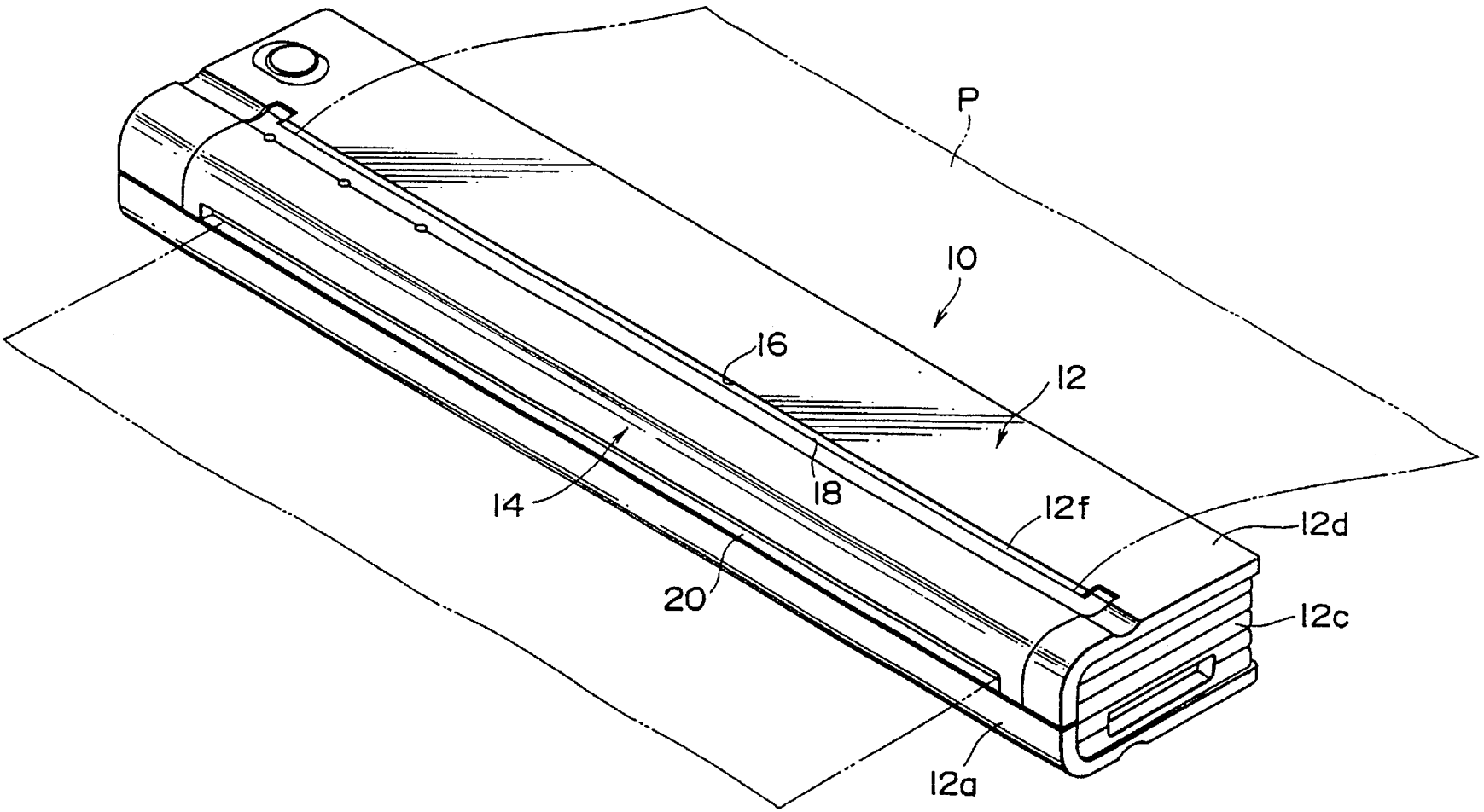
FIG. 1 is a perspective view of an embodiment of a thermal printer in accordance with the present invention, with the cover closed.
Figure 2:
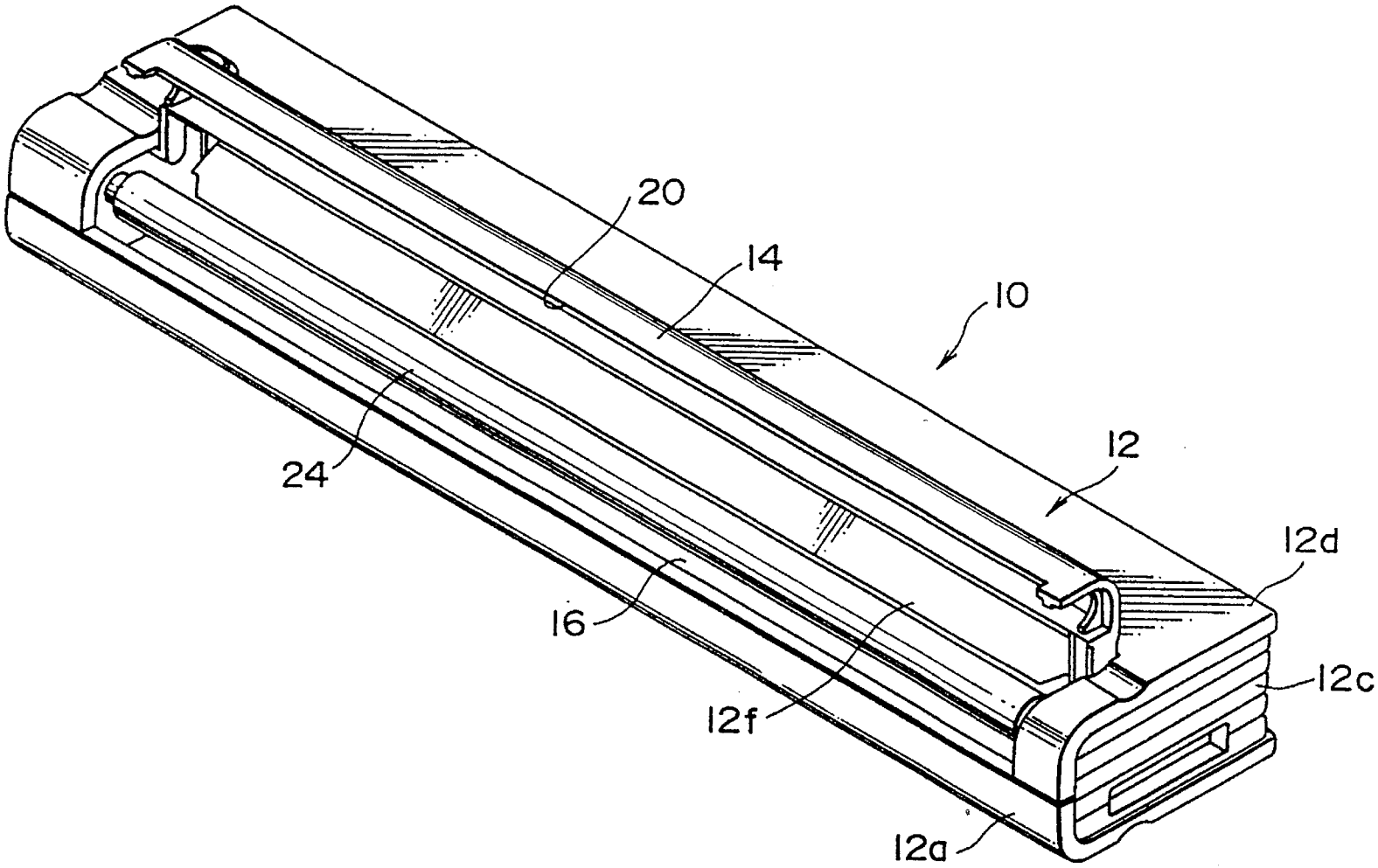
FIG. 2 is a perspective view of the thermal printer of FIG. 1, with the cover open.

As shown in FIGS. 1 and 2, a thermal printer 10 includes a housing 12 and a cover 14. The cover 14 allows access the interior of the housing 12. The housing 12 also includes an opening 16, formed between a the top surface and a front side surface of an upper housing portion 12*d* of the housing 12. The cover 14 is swingably fitted in the opening 16 to open and close. The cover 16 has front and rear (with reference to FIG. 1) recesses formed therein. A paper insertion slot 18 is defined between the rear recess of the cover 14 and the top surface edge of the upper housing 12*d*. Similarly, a paper discharge slot 20 is defined between the front recess of the cover 16 and a side surface edge of a lower housing portion 12*a*.

The cover 14 is held swingably by corner axes 14*b* near its rear corners, and is swingable between a closed position (shown in FIG. 1) and an open position (shown in FIG. 2). When closed, the cover 14 is substantially flat with reference to the top surface of the upper housing portion 12*d*, and forms the paper insertion and discharge slots 18 and 20, as described above.

Figure 3:
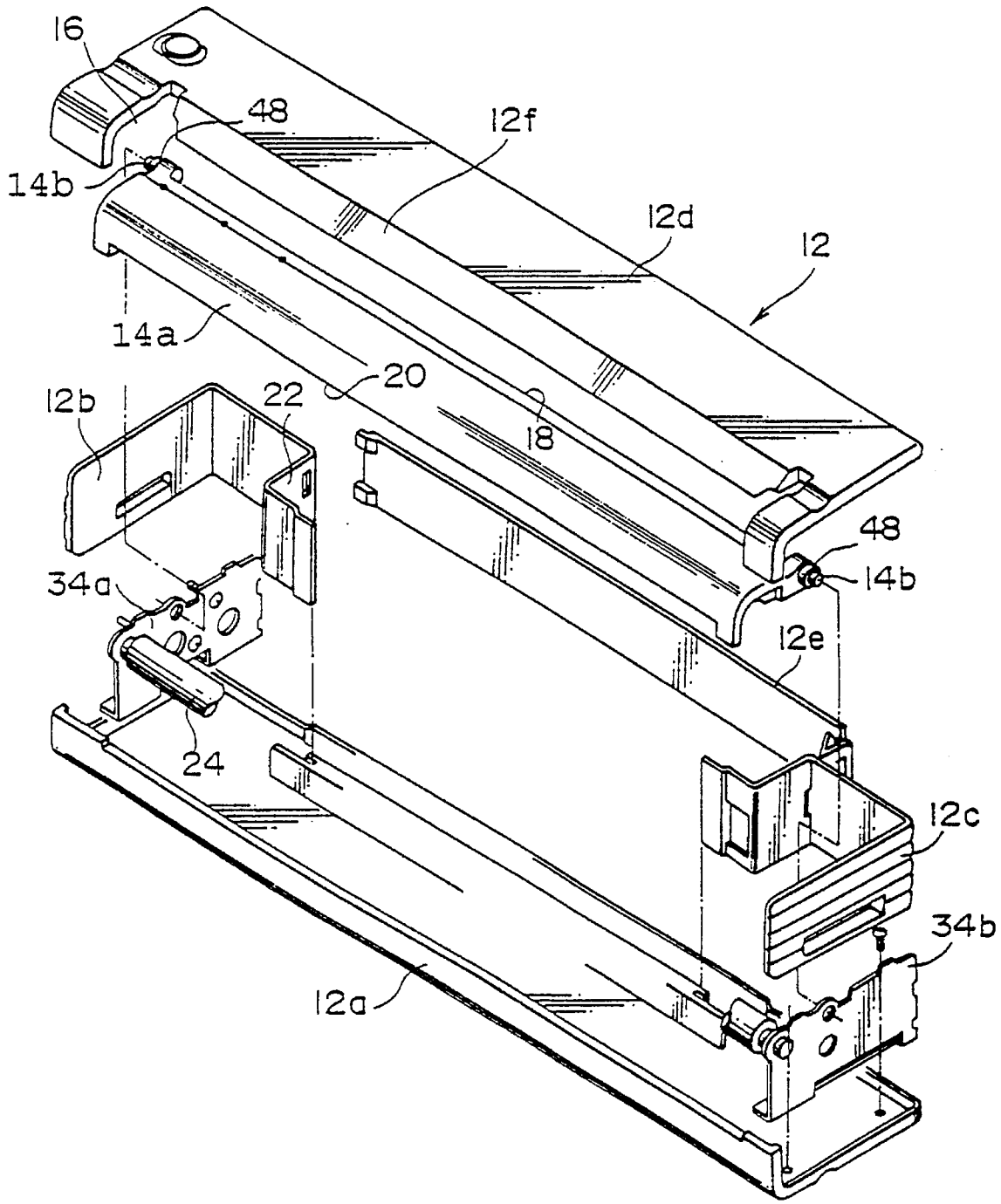
FIG. 3 is an exploded perspective view of the thermal printer of FIG. 1.

As shown in FIG. 3, the housing 12 includes: the lower housing 12*a*; left and right side covers 12*b* and 12*c*, respectively, provided on the sides of the lower housing 12*a*; the upper housing 12*d*, fixed on the side covers 12*b*, 12*c*; a battery chamber cover 12*e* at the rear of the housing 12 for covering the battery chamber 22 (shown in FIG. 6); and a guide plate 12*f*, formed at the front edge of the upper housing 12*d* and defining an upper boundary of the opening 16. All of the housing component parts 12*a* through 12*f* are made of plastic materials.

The guide plate 12*f*, which guides paper to a line contact region between the rotatable platen roller 24 and the thermal line printhead, is integrally formed with the housing 12, extending downwards and forward from the top surface edge of the upper housing 12*d*. The side surface edge of the lower housing 12*a* extends across the width of the lower housing without breaks or steps, and defines both the lower boundary of the opening 16 and the lower boundary of the paper discharge slot 20. The side surface edge of the lower housing 12*a* at the paper discharge slot 20 are straight (no breaks or steps) to ensure the strength of the slot edge.

Figure 4:
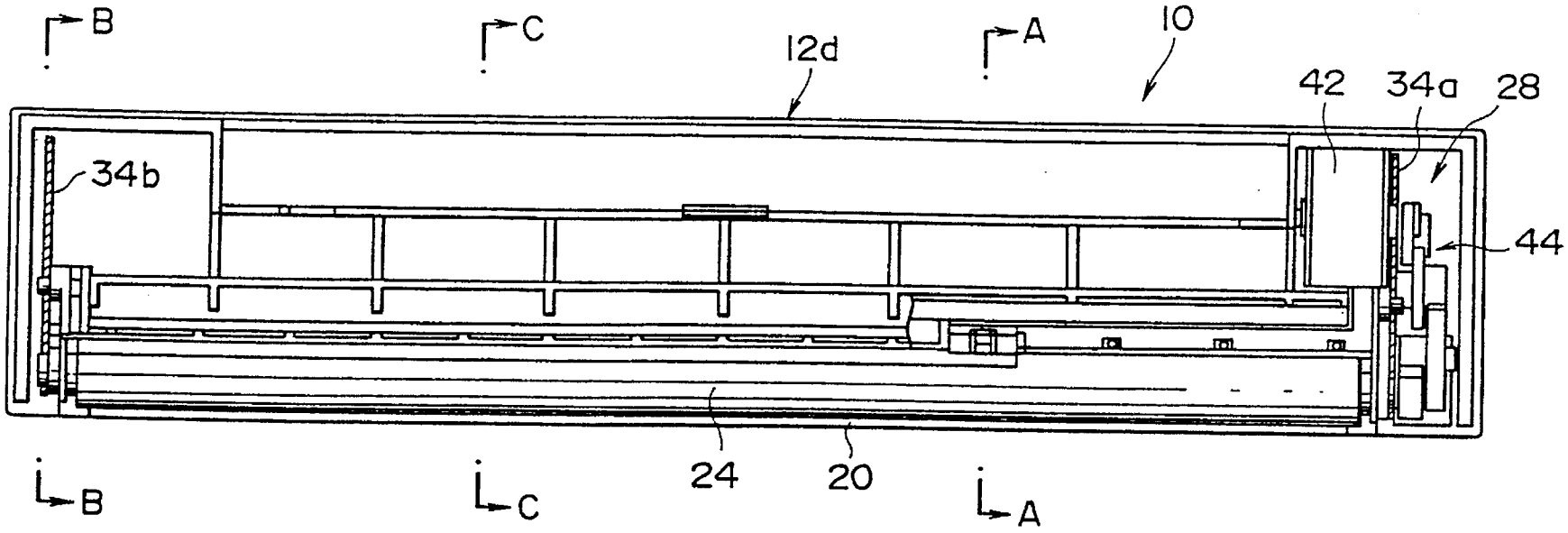
FIG. 4 is a bottom plan view of the thermal printer of FIG. 1, with a lower housing portion removed.
Figure 5:
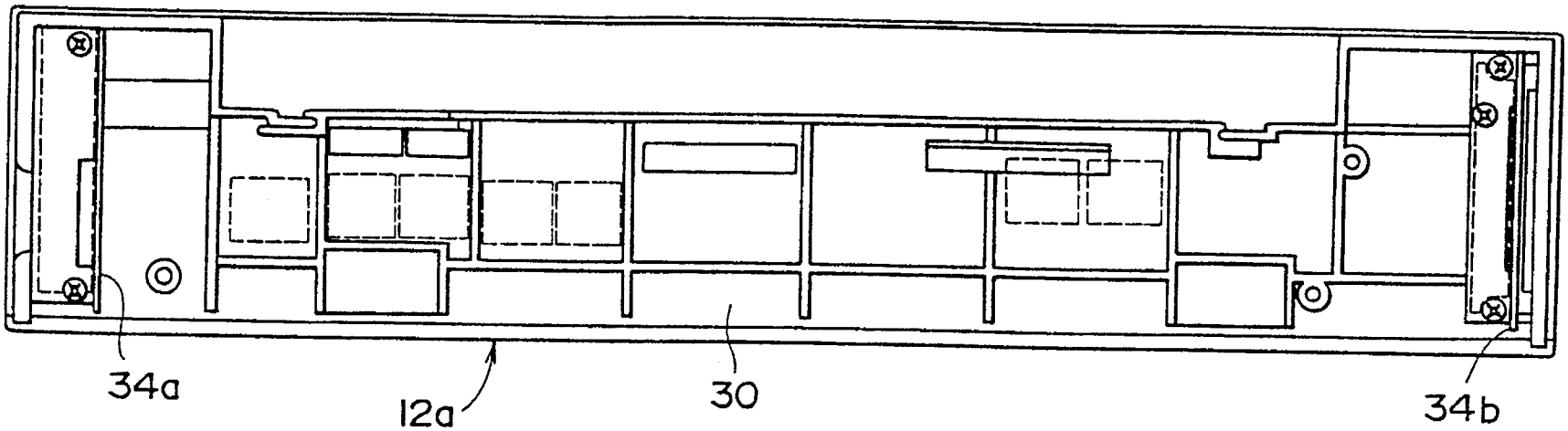
FIG. 5 is a top plan view of the lower housing portion of the thermal printer of FIG. 1.
Figure 6:
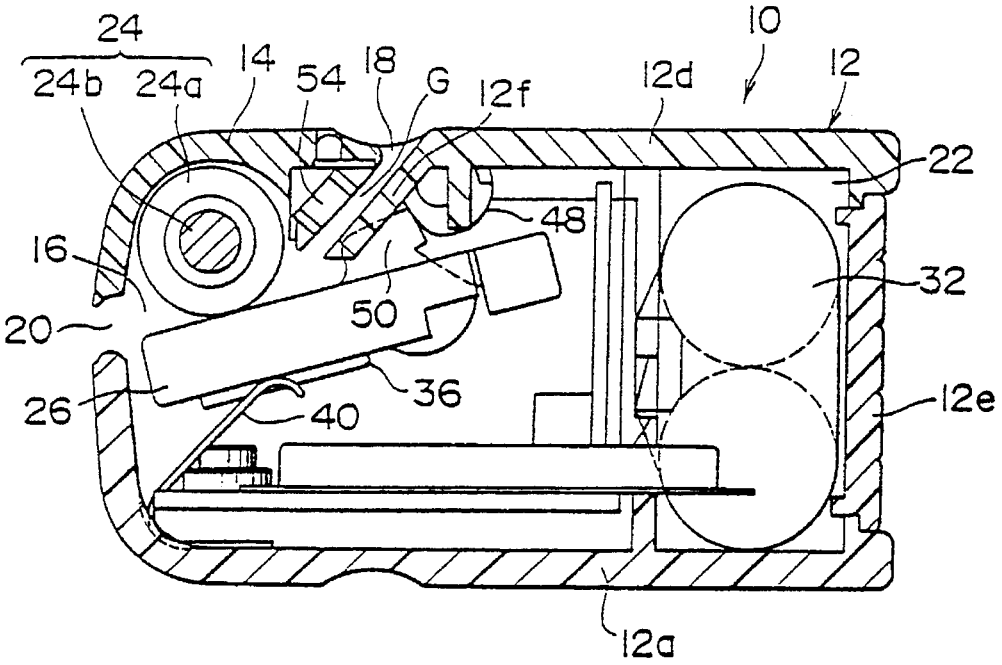
FIG. 6 is a sectional view of the thermal printer of FIG. 1, along the A—A sectional line shown in FIG. 4.

FIGS. 4 to 9 detail the internal structural arrangement of the housing 12. As shown in FIG. 4, the major internal structural parts include: the rotatable platen roller 24 extending in the lateral direction of the paper; the thermal line printhead 26 (shown in FIGS. 6 to 9) contactable to, and swingable towards and away from, the platen roller 24; a driving mechanism 28 for the platen roller 24; a control circuit 30 (shown in FIG. 5) mounted on the bottom of the lower housing 12*a*; and a set of rechargeable batteries 32 (shown in FIG. 6) for supplying power to the printer, stored in the battery chamber 22. As shown in FIG. 6, the platen roller 24 also includes a roller portion 24*a*, having a predetermined elasticity; and axes 24*b* which protrude from both ends of the roller portion 24*a*. The control circuit 30 controls the heat emitting conditions of the thermal line printhead 26 and the driving movement of the driving mechanism 28, as determined by incoming printing image information from a data input port (not shown). In this embodiment, the rechargeable batteries 32 are nickel-cadmium batteries.

FIG. 4 shows a bottom view of the thermal printer 10, with the lower housing 12*a* removed. The driving mechanism 28 is mounted inside the right side mounting plate 34*a* as shown in FIG. 4. The driving mechanism 28 includes a driving motor 42, having an axis extending outward from the mounting plates 34*a*, and a gear train 44 mounted on the external face of the mounting plate 34*a*. The gear train 44 transmits the driving power of the driving motor 42 to rotate the platen roller 24 clockwise (from the perspective of FIG. 6).

Figure 7:
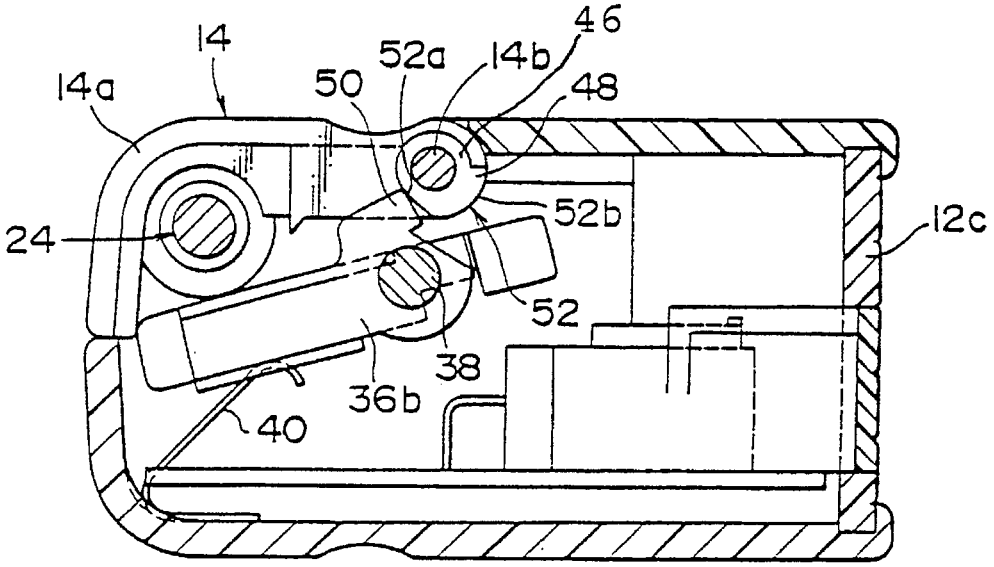
FIG. 7 is a sectional view of the thermal printer of FIG. 1, along the B—B sectional line shown in FIG. 4.
Figure 8:
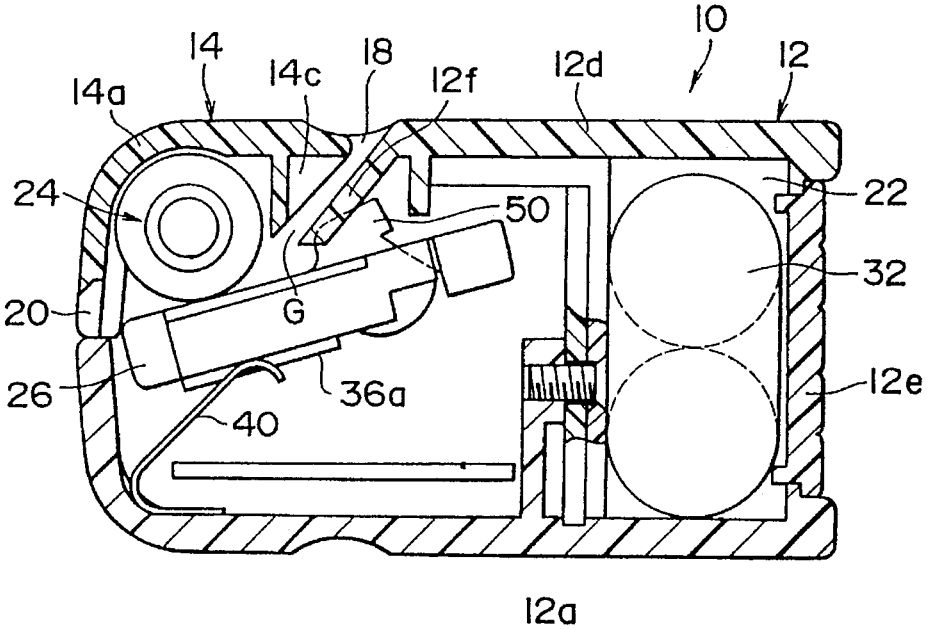
FIG. 8 is a sectional view of the thermal printer of FIG. 1, along the C—C sectional line shown in FIG. 4.

As shown in FIG. 7, the cover 14 includes a main body 14*a* and axes 14*b*. The axes 14*b* are integrally formed with the main body of the cover, and extend from both the left rear and right rear corners of the cover 14*a*. As shown in FIG. 8, a series of guide ribs 14*c* are formed in the cover 14 to face the guide plate 12*f* when the cover 14 is closed. The guide ribs 14*c* are a predetermined distance from the guide plate 12*f*, sufficient to allow paper to insert through the resulting insertion slot 18. The guide ribs 14*c* and guide plate 12*f* form a guide transfer channel G to guide the thermosensitive paper to the contact line between the rotatable platen roller 24 and the thermal line printhead 26 from an upper oblique angle. A sensor 54 is provided to detect a paper insertion.

Upright metallic mounting plates 34*a* and 34*b* are fixed on both left and right ends of the lower housing 12*a*, as shown in FIGS. 4 and 5. The axes 14*b*, 14*b* of the cover 14 are rotatably supported between the mounting plates 34*a* and 34*b*. The axis 24*b* of the platen roller 24 is also rotatably supported by the mounting plates 34*a* and 34*b*.

A pair of swingable supporting frames 36*a* and 36*b* are provided on the ends of the thermal line printhead 26. Each of the frames 36*a* and 36*b* is provided with an axis 38 swingably supported by the mounting plates 34*a* and 34*b*. Thus, the thermal line printhead 26 rotates by means of the swingable supporting frames 36*a* and 36*b*, and with reference to the mounting plates. The mounting plates 34*a* and 34*b* each include a cam follower 50. The cam followers 50, 50 contact cams 48, 48 of a release mechanism 46 (described later). Further, the thermal line printhead 26 is biased by a plate spring 40 (fixed on the bottom of the lower housing 12*a*) to swing towards, and contact, the platen roller 24. The plate spring 40 also biases the thermal line printhead 26 such that the cam followers 50, 50 maintain contact with the corresponding cams 48, 48 of the release mechanism 46 when the cover 14 is swung open.

The release mechanism 46 guides the thermal line printhead 26 away from the platen roller 24 when the cover is opened (against the bias of the plate spring 40), and allows the thermal line printhead 26 to contact the platen roller 24 when the cover is closed (under the bias of the plate spring 40).

Figure 9:
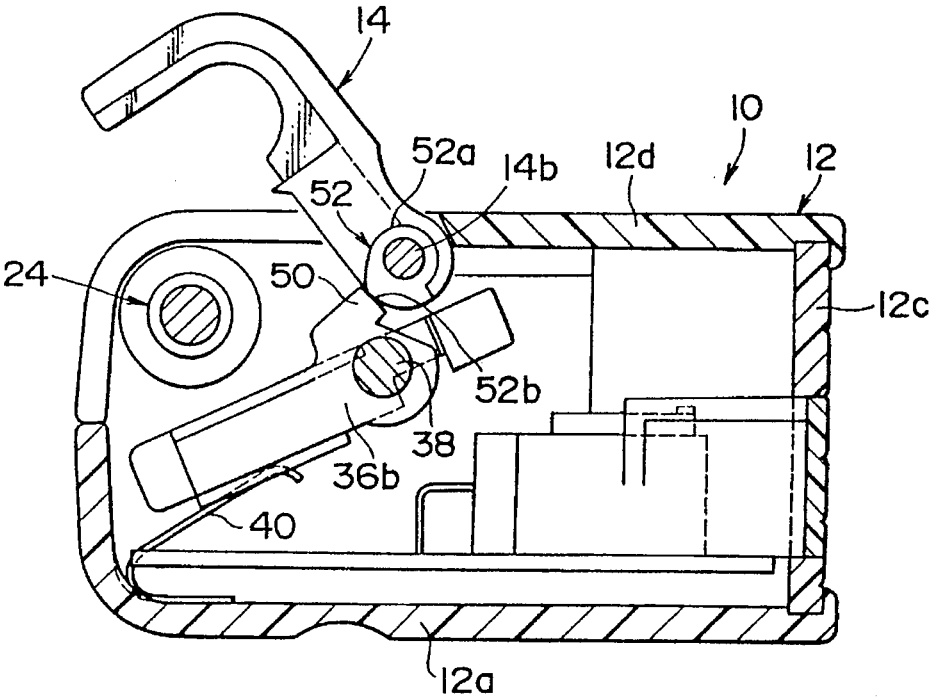
FIG. 9 is a sectional view of the thermal printer of FIG. 4, taken along section line B—B with the cover open.

As shown in FIGS. 7 and 9, the release mechanism 46 includes the cams 48, 48, integrally formed at the bases of the axes 14*b* of the cover 14. Each cam 48 is formed with a cam surface 52; and each cam surface 52 includes a first cam sector 52*a* and a second cam sector 52*b*. The cam surfaces 52, 52 are engageable with the cam followers 50, 50 of the supporting frames 36*a*, 36*b*. The second cam sectors 52*b*, 52*b* have an increasing diameter to force the thermal line printhead 26 to separate from the platen roller 24 when the cover is opened (against the spring tension of the plate spring 40, and shown in FIG. 2). The first cam sectors 52*a*, 52*a* have a smaller diameter than the second cam sectors 52*b*, 52*b*, to allow the thermal line printhead 26 to return and contact the platen roller 24 under the spring tension from plate spring 40 when the cover is closed (shown in FIG. 1).

The cam 48 is shaped within second cam sectors 52*b* such that when the cover 14 moves beyond a predetermined amount of swinging, the radius of the cam 48 becomes constant within the cam sector 52*b*. In the constant radius portion of the second cam sector 52*b*, the returning force of the plate spring 40 does not transmit to the cover 14, and the cover 14 is held in the open position. However, in the remaining portion of the second cam sector 52*b*, the radius of the cam 48 is not constant, and the returning force of the plate spring 40 does transmit to the cover 14, urging the cover 14 to close. Thus, the cam 48 holds the cover 14 in the open position when the cover 14 moves beyond a predetermined amount of swinging, and also urges the cover 14 towards the closed position when the cover 14 moves less than the predetermined amount of swinging.

Further, the thermal line printhead 26 is pressed against the platen roller 24 with a predetermined pressure (according to the plate spring 40) when the cover 14 is closed. The thermosensitive paper, held between the thermal line printhead 26 and the platen roller 24, is transferred toward the paper discharge slot 20 by the rotation of the platen roller 24 (driven by the driving mechanism 28). When the cover 14 opens, the second cam sectors 52*b*, 52*b* of the cams 48, 48 engage the cam followers 50, 50, of the supporting frames 36*a* and 36*b*. The thermal printhead 26 thereby swings counterclockwise, against the spring tension of the plate spring 40, and away from the platen roller 24. As shown in FIG. 9, the thermal line printhead 26 separates from the platen roller 24, and a predetermined gap, depending on the radius of the second cam sectors 52*b* (in the constant radius portion) is formed therebetween.

The thermal line printhead 26 is rotatably supported by the metallic supporting frames 36*a* and 36*b*, and is directly driven by the cover 14 opening operation to separate from the platen roller 24. The thermal printer 10 arranged in this manner allows easy insertion of thermosensitive paper between the thermal line printhead 26 and the platen roller 24. If paper jams between the thermal line printhead 26 and the platen roller 24, the paper can be removed easily. Furthermore, opening the cover 14 and forcing the thermal line printhead 26 to separate from the platen roller 24 places no significant mechanical load on the plastic housing 12, as both the thermal line printhead 26 and the platen roller 24 are rotatably supported by the rigid metallic mounting plates 34*a* and 34*b*. Still further, the mechanical strength of the lower housing 12*a* is not compromised by a large thermosensitive paper discharge slot 20, as the recess for the paper discharge slot 20 is formed entirely on the cover 14 (instead of the lower housing 12*a*). Therefore, the supporting frames 34*a* and 34*b* are firmly mounted on the lower housing 12, increasing the overall durability. These improved structural arrangements make the removal of a jammed paper through the large paper discharge slot 20 easier, and allow several functions to be shared among a few structural elements.

The present invention is not limited by the embodiment described above, and may be constructed with variations in structure without departing from the scope and spirit of the present invention.

Thus, the present invention provides a thermal printer having improved mechanical strength and durability. The large and accessible paper discharge slot allows easy access for feeding paper and for removing jammed paper. Furthermore, a thermal printer according to the present invention is improved in its capability for allowing the separation of the thermal printhead and the platen roller in response to a release operation.

The present disclosure relates to subject matter contained in Japanese Patent Application No. HEI 06-128329, filed on May 18, 1994, which is expressly incorporated herein by reference in its entirety.

What is claimed is:

1. A thermal printer comprising:

a platen roller rotatably supported in said printer;

a thermal line printhead swingably supported in said printer, said thermal line printhead being contactable to, and swingable towards and away from, said platen roller;

biasing means for biasing said thermal line printhead to swing towards said platen roller;

a covering member rotatably supported in said printer, said covering member being swingable about an axis to allow access to an interior of said printer; and means for guiding said thermal line printhead away from contact with said platen roller, in response to swinging of said cover member to allow access to said interior of said printer, and against a bias of said biasing means, said guiding means comprising a cam mounted to, and movable unitarily with, said covering member, and a cam follower mounted to, and movable unitarily with, said thermal line printhead, said cam follower following movement of said cam.

2. The thermal line printer according to claim 1, wherein said cam is formed about said axis of said covering member and said cam follower is displaced from a swinging axis of said swingable thermal line printhead.

3. The thermal line printer according to claim 2, wherein said printer further comprises at least one swingable support frame, said swingable support frame rigidly holding said thermal line printhead while being swingable relative to said platen roller, and said swingable line printhead being swingable by means of said at least one support frame, and said cam follower is mounted to said at least one swingable support frame.

4. The thermal printer according to claim 1, said printer further comprising:

a housing;

said covering member being swingable between an open position that allows access through said housing to said interior of said printer, and a closed position; and said covering member having a first recess and a second recess formed therein, said first recess forming a paper insertion slot at an edge of said housing, and said second recess forming a paper discharge slot at another edge of said housing, when said covering member is in said closed position.

5. The thermal printer according to claim 4, wherein said housing includes a top surface and a side surface, each of said top and side surfaces having an edge facing said covering member when said covering member is in said closed position, and wherein said first recess of said covering member faces said edge of said top surface to form said paper insertion slot, and said second recess of said covering member faces said edge of said side surface to form said paper discharge slot, when said covering member is in said closed position.

6. The thermal printer according to claim 5, said housing further comprising:

a lower housing, said lower housing supporting a pair of fixed mounting plates, and wherein each of said platen roller, said thermal line printhead, and said cover are rotatably supported on said fixed mounting plates; and an upper housing fitted on top of said lower housing, said upper housing including said top surface and said edge of said top surface, and said lower housing including said side surface and said edge of said side surface.

7. The thermal printer according to claim 6, wherein said lower housing and upper housing are made of plastic, and said pair of mounting plates are made of metal.

8. The thermal printer according to claim 1, wherein said guiding means further comprises means for holding said covering member in position when said covering member moves beyond a predetermined swing amount, and for returning said covering member to a predetermined position when said covering member moves less than said predetermined swing amount.

9. The thermal printer according to claim 1, wherein said rotating axis of said covering member, a swinging axis of said thermal line printhead, and a rotating axis of said platen roller are parallel to one another.

10. The thermal printer according to claim 1, said cam follower contacting said cam.

11. The thermal printer according to claim 1, said cam being mounted for rotation about said axis of said covering member.

12. A thermal line printer comprising:

a platen roller rotatably supported in said printer;

a thermal line printhead swingably supported in said printer, said thermal line printhead being contactable to, and swingable towards and away from, said platen roller;

biasing means for biasing said thermal line printhead to swing towards said platen roller;

a housing;

a covering member swingably supported in said printer, said covering member being swingable about an axis between an open position that allows access through said housing to an interior of said printer, and a closed position;

said covering member having first and second recesses formed therein, said first recess forming a paper insertion slot at an edge of said housing, and said second recess forming a paper discharge slot at another edge of said housing, when said covering member is in said closed position;

said covering member having first and second contact portions on each side of said second recess, respectively, said first and second contacting portions defining a height and width of said discharge slot when said contact portions contact said housing; and means for guiding said thermal line printhead away from contact with said platen roller, in response to swinging of said cover member to allow access to said interior of said printer, and against a bias of said biasing means, said means comprising a cam mounted to, and movable unitarily with, said covering member, and a cam follower mounted to, and movable unitarily with, said thermal line printhead, said cam follower following movement of said cam.

13. The thermal printer according to claim 12, wherein said housing includes a top surface and a side surface, each of said top and side surfaces having an edge facing said covering member when said covering member is in said closed position, and wherein said first recess of said covering member faces said edge of said top surface to form said paper insertion slot, and said second recess of said covering member faces said edge of said side surface to form said paper discharge slot, when said covering member is in said closed position.

14. The thermal printer according to claim 13, said housing further comprising:

a lower housing, said lower housing supporting a pair of fixed mounting plates, and wherein each of said platen roller, said thermal line printhead, and said cover are rotatably supported on said fixed mounting plates; and an upper housing fitted on top of said lower housing, said upper housing including said top surface and said edge of said top surface, and said lower housing including said side surface and said edge of said side surface.

15. The thermal printer according to claim 14, wherein said lower housing and said upper housing are made of plastic, and said pair of mounting plates are made of metal.

16. The thermal printer according to claim 12, said guiding means comprising means for holding said covering member in position when said covering member moves beyond a predetermined swing amount, and for returning said cover member to a predetermined position when said covering member moves less then said predetermined swing amount.

17. The thermal printer according to claim 12, wherein said axis of said covering member, a swinging axis of said thermal printhead, and a rotating axis of said platen roller are parallel to each other.

18. The thermal printer according to claim 12, said cam follower contacting said cam.

19. The thermal printer according to claim 12, said cam being mounted for rotation about said axis of said covering member.

* * * * *

UNITED STATES PATENT AND TRADEMARK OFFICE

CERTIFICATE OF CORRECTION

PATENT NO. : 5,599,113

DATED : February 4, 1997

INVENTOR(S) : M. SUZUKI et al.

It is certified that error appears in the above-indentified patent and that said Letters Patent is hereby corrected as shown below:

At column 8, line 46 (claim 16, line 6), change "then" to ---than---.

Signed and Sealed this

Twentieth Day of May, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,599,113

DATED : February 4, 1997

INVENTOR(S) : M. SUZUKI et al.

It is certified that error appears in the above-indentified patent and that said Letters Patent is hereby corrected as shown below:

At column 4, lines 49-50, change "mounting plates 34*a* and 34*b*" to ---swingable supporting frames 36*a* and 36*b*---.

Signed and Sealed this

Twenty-first Day of April, 1998

Bruce Lehman

*Attest:*

BRUCE LEHMAN

*Attesting Officer*

*Commissioner of Patents and Trademarks*